US010987534B2

(12) United States Patent
DeYoung

(10) Patent No.: US 10,987,534 B2
(45) **Date of Patent: *Apr. 27, 2021**

(54) EXERCISE GARMENT

(71) Applicant: John G. DeYoung, Santa Monica, CA (US)

(72) Inventor: John G. DeYoung, Santa Monica, CA (US)

(73) Assignee: John G. DeYoung, Santa Monica, CA (US)

( * ) Notice: Subject to any disclaimer, the term of this patent is extended or adjusted under 35 U.S.C. 154(b) by 37 days.

This patent is subject to a terminal disclaimer.

(21) Appl. No.: 16/175,217

(22) Filed: Oct. 30, 2018

(65) Prior Publication Data

US 2019/0134446 A1 May 9, 2019

Related U.S. Application Data

(63) Continuation of application No. 14/694,450, filed on Apr. 23, 2015, now Pat. No. 10,118,063.

(Continued)

(51) Int. Cl.

| | |
|---|---|
| ***A63B 21/00*** | (2006.01) |
| ***A63B 21/055*** | (2006.01) |
| ***A63B 23/04*** | (2006.01) |
| ***A41D 1/08*** | (2018.01) |
| ***A63B 21/04*** | (2006.01) |
| ***A63B 23/035*** | (2006.01) |

(52) U.S. Cl.

CPC ..... *A63B 21/00* (2013.01); *A63B 21/00069* (2013.01); *A63B 21/0552* (2013.01); *A63B 21/4011* (2015.10); *A63B 21/4025* (2015.10); *A63B 23/0482* (2013.01); *A41D 1/08* (2013.01); *A63B 21/0442* (2013.01); *A63B 21/0557* (2013.01); *A63B 23/03508* (2013.01); *A63B 23/03533* (2013.01); *A63B 23/0405* (2013.01); *A63B 2209/10* (2013.01)

(58) Field of Classification Search

CPC .... A41F 3/00; A41F 3/02; A41D 1/06; A41D 1/08; A41D 1/082; A41D 1/084; A41D 1/086; A41D 1/12

See application file for complete search history.

(56) References Cited

U.S. PATENT DOCUMENTS 1,272,034 A * 7/1918 Gregg ..... A41D 1/08 2/228
1,405,114 A * 1/1922 Hall ..... A41D 1/086 2/227

(Continued)

*Primary Examiner* — Alissa J Tompkins
*Assistant Examiner* — Brieanna Szafran
(74) *Attorney, Agent, or Firm* — Dentons Cohen & Grigsby P.C.

(57) ABSTRACT

A fabric-like, elastic, exercise resistance band with first and second ends, permanently affixed to the end of each leg section of an exercise pant garment that extends to at least just below the knee area. The resistance bands comprise a resilient material and offer no resistance when formed to each leg, out of the way for everyday activities. When the resistance bands are unformed and fastened together by way of a locking canister affixed to each resistance band, the muscles of the lower body, primarily the inner thighs and buttocks, may be stimulated as the legs are moved further apart during a resistance exercise program.

20 Claims, 7 Drawing Sheets

Related U.S. Application Data

(60) Provisional application No. 61/983,864, filed on Apr. 24, 2014.

(56) References Cited

U.S. PATENT DOCUMENTS 1,821,818 A * 9/1931 Snyder ..... A41D 1/06 2/227
2,434,714 A * 1/1948 Newcombe ..... A41D 1/06 2/237
2,663,876 A * 12/1953 Miller ..... A41D 1/06 2/227
4,601,066 A * 7/1986 Campbell ..... A41D 1/04 2/70
4,894,867 A * 1/1990 Ceravolo ..... A41D 1/08 2/238
5,201,074 A * 4/1993 Dicker ..... A63B 21/0552 2/70
5,267,928 A * 12/1993 Barile ..... A63B 21/4025 2/228
5,357,637 A * 10/1994 Moore ..... A63B 21/4025 2/227
5,490,826 A * 2/1996 Rose ..... A63B 21/4011 482/74
5,555,561 A * 9/1996 Plachta ..... A41D 13/0005 2/457
5,573,487 A * 11/1996 Wallner ..... A63B 21/0004 482/122
5,720,042 A * 2/1998 Wilkinson ..... A63B 21/4043 2/69
5,857,947 A * 1/1999 Dicker ..... A63B 21/4043 482/124
5,968,002 A * 10/1999 Morrisseau ..... A61F 5/0102 128/869
6,651,258 B2 * 11/2003 Pelensky ..... A41B 13/005 2/227
6,719,712 B2 * 4/2004 Zigmont ..... A61F 5/02 2/69
7,194,770 B1 * 3/2007 Fecenko ..... A41D 1/06 2/227
8,932,190 B2 * 1/2015 Moore ..... A63B 21/4011 482/124
D726,841 S * 4/2015 Wright ..... D21/662
9,032,556 B2 * 5/2015 Willis ..... A41D 31/18 2/228
D743,147 S * 11/2015 Clark ..... D2/858
10,118,063 B2 * 11/2018 DeYoung ..... A63B 21/00
2003/0172440 A1 * 9/2003 Waxberg ..... A41D 1/08 2/220
2003/0192106 A1 * 10/2003 Robinett ..... A41D 1/08 2/228
2005/0261113 A1 * 11/2005 Wilkinson ..... A63B 21/00069 482/124
2011/0041226 A1 * 2/2011 Arensdorf ..... A41D 13/0543 2/22
2015/0258362 A1 * 9/2015 Cornish ..... A63B 21/0004 482/124
2015/0305413 A1 * 10/2015 DeYoung ..... A63B 21/4011 2/229
2019/0351278 A1 * 11/2019 Walker ..... A63B 21/00043

* cited by examiner

EXERCISE GARMENT

CROSS REFERENCE TO RELATED APPLICATION

This application is a continuation application of U.S. application Ser. No. 14/694,450, filed on Apr. 23, 2015, U.S. Pat. No. 10,118,063, which claims the benefit of U.S. Provisional Application No. 61/983,864, filed on Apr. 24, 2014, the disclosures of each of which is hereby incorporated by reference in its entirety.

TECHNICAL FIELD

The present invention relates to exercise garments, and more particularly to exercise pants comprising affixed exercise resistance bands on each leg portion of the garment, and methods of using the same.

BACKGROUND

Various special exercise garments have been made to provide isometric exercising for the legs and arms. These garments are generally specialty garments that are worn for the purpose of aerobic exercises only and generally have resistance bands sewn into the garments mainly down the arms and legs. For example, U.S. Pat. No. 5,201,074, includes bands that encircle the legs from the hips to the ankle, or in the case of short pants, from the waist to the end of the pants. Other garments have pockets or channels in the garment itself to allow a resistance band to slide into the pockets or channels during exercising and removed after exercising as in U.S. Pat. No. 6,258,014. Other devices, U.S. Pat. Nos. 5,186,701 and 2,097,376, use bands that encircle the waist, ankles and wrists with elastic straps between the bands. The devices are cumbersome and are not suitable for wearing when not exercising.

Individual stretchable exercise resistance bands that are not attached to clothing are described in U.S. Pat. Nos. 3,819,177, 4,815,731 and 5,357,637. These devices are used primarily for exercising the muscles of the legs in conjunction with exercise pant garments or a more casual, everyday pant but do not allow for spontaneity because the stretchable exercise resistance bands are not permanently attached to the pant garment and must be carried with you to perform exercises for the lower body and then removed and stored when not in use.

U.S. Pat. No. 5,109,546 relates to an exercise suit with form fitting pants and a pullover top made of a stretchable material having reinforcing segments with helically wound leg and arm resistance bands attached integrally to the suit.

While such garments may have been satisfactory for certain situations they offer limited resistance to tone muscles and generally could not be casually worn while performing normal daily activities.

Therefore, it would be desirable to have an exercise garment that is comfortable to wear and/or provides sufficient muscle toning.

In U.S. Pat. No. 5,176,600, the leg portion of the device has an elastic resistance web that may be permanently attached to one leg, or completely removable, and is anchored to the opposing leg by means of hooks/loops or other types of fasteners to perform exercises for the lower body. This device does not allow the user to train the muscles of the lower body, more precisely the buttocks or inner thighs, one leg at a time since it is not intended to be affixed to a stationary object. Also, the resistance may only be increased or decreased by having to have additional resistant webs with various tensions. Furthermore, this also prevents the user from exercising the muscles of the inner thigh.

SUMMARY

A exercise pant garment may generally comprise an upwardly disposed waist, a seat spaced apart from and connected to a pant front, the seat and the pant front connected to the waist, two spaced apart leg sections connected to the seat and the pant front, and an elongated fabric, exercise band coupled to each leg section, wherein the exercise band comprises a first free end, a second free end, and a portion between the first and second free ends permanently fixed about a knee area of the leg section of the exercise pant garment, wherein the first and/or second free end of the exercise band has a length sufficient to attach to the first and/or second free end of the exercise band of the other leg section and/or a stationary object to provide sufficient resistance to the movement of the legs away from each other to stimulate muscles of the lower body during a resistance exercise program.

A method of performing an exercise program wherein a user does a primary exercise involving repeated side to side movement of the user's legs may generally comprise providing an exercise pant garment comprising an upwardly disposed waist, a seat spaced apart from and connected to a pant front, the seat and the pant front connected to the waist, two spaced apart leg sections connected to the seat and the pant front, and a pair of elongated fabric, exercise resistance bands each having first and second free ends and coupled about a knee area of one of the leg sections of the exercise pant garment, wherein the first and/or second free end of the exercise band has a length sufficient to attach to the first and/or second free end of the exercise band of the other leg section and/or a stationary object to provide sufficient resistance to the movement of the legs away from each other to stimulate muscles of the lower body during a resistance exercise program.

BRIEF DESCRIPTION OF THE DRAWINGS

The various embodiments described herein may be better understood by considering the following description in conjunction with the accompanying drawings.

DETAILED DESCRIPTION

Figure 1:
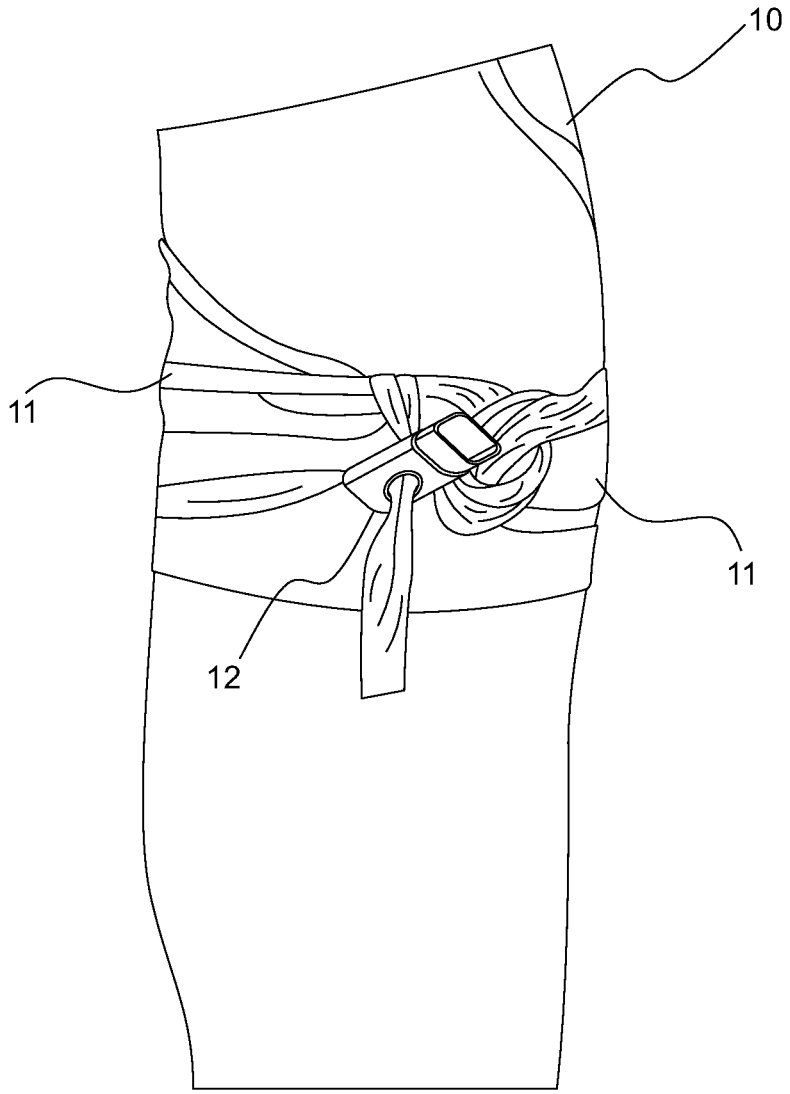
FIGS. 1 and 2 illustrate side views of a leg section of an exercise pant garment comprising an elongated fabric, exercise band coupled to the leg section during a period of use according to various embodiments.

All numerical quantities stated herein are approximate, unless indicated otherwise, and are to be understood as being prefaced and modified in all instances by the term "about". The numerical quantities disclosed herein are to be understood as not being strictly limited to the exact numerical values recited. Instead, unless indicated otherwise, each numerical value included in the present disclosure is intended to mean both the recited value and a functionally equivalent range surrounding that value.

All numerical ranges recited herein include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value equal to or less than 10.

As generally used herein, the articles "one", "a", "an", and "the" refer to include "at least one" or "one or more" of what is claimed or described, unless indicated otherwise. For example, "a component" means one or more components, and thus, possibly, more than one component is contemplated and may be employed or used in an implementation of the described embodiments.

As generally used herein, the terms "include", "includes", and "including" are meant to be non-limiting.

As generally used herein, the terms "have", "has", and "having" are meant to be non-limiting.

The present invention relates to exercise garments and more particularly to exercise pants that offer a method for providing muscle conditioning when employing the affixed exercise resistance bands on each leg portion of the garment to perform a number of toning exercises for the muscles of lower body.

The present invention may provide a supplemental exercise resistance program for the muscles of the lower body primarily the buttocks and inner thighs in an automatic manner as a result of the movement of the legs moving further apart during specific exercises of a resistance exercise program or further apart when the legs are used independent of each other for the muscles of the lower body primarily the adductors or inner thighs as a result of the movement of the legs moving further or closer together when exercising both legs at the same time or individually, when secured to a stationary object, during specific resistance exercises.

The present invention may provide an exercise pant garment which is capable of providing the supplementary resistance exercises to a main resistance program.

The present invention may provide such an exercise garment which requires minimal modifications to normal garment technology and that the invention itself is inconspicuous when formed to itself during periods of non-use.

The present invention may provide such an exercise garment which is capable of being modified to vary the degree of resistance encountered during the supplemental exercise program.

The exercise garment may be used for providing resistance during specific leg movements found in distinct resistance exercises for the lower body such as lateral band walk, standing adduction, standing abduction, supinated clamshell, supine glute bridge, seated abduction, laying leg scissors, etc. Where it is intended to provide resistance to the movement of the legs, the pant garment would include two leg sections that extend to at least about the knee area and have a fabric-like, exercise, resistance band, with first and second ends, permanently affixed to the end of each leg section at the inseam and hem. The resistance bands would be interconnected and span the distance of the leg sections and made of an elastic material that is stretchable and resilient that when the legs are moved further away from each other resistance is encountered causing the material to stretch. The material would then tend to resume its normal unstretched condition as the legs move back towards each other.

Each exercise resistance band is permanently attached to each leg section of the pant garment and can be formed to each leg section and out of the way during periods of non-use so that the garment could be worn during other resistance programs, aerobic activities or during periods of non-exercise, everyday activities.

The present invention may provide such an exercise garment which is capable of offering varying degrees of resistance during a supplemental exercise program quickly and without having to make any modifications to the garment itself.

An exercise pant garment may generally comprise an upwardly disposed waist, a seat spaced apart from and connected to a pant front, the seat and the pant front connected to the waist, two spaced apart leg sections connected to the seat and the pant front, and an elongated fabric, exercise band coupled to each leg section, wherein the exercise band comprises a first free end, a second free end, and a portion between the first and second free ends permanently fixed about a knee area of the leg section of the exercise pant garment, wherein the first and/or second free end of the exercise band independently comprise a length sufficient to extend around the knee area and attach to the first and/or second free end of the exercise band of the other leg section, spanning the space between the leg sections to provide sufficient resistance to the movement of the legs away from each other to stimulate muscles of the lower body during a resistance exercise program, and/or a length sufficient to couple to a stationary object, spanning the space between the leg section and stationary object to provide sufficient resistance to the movement of the leg away from the stationary object to stimulate muscles of the lower body during a resistance exercise program. The length and/or resistance of each free end may be the same or different.

The exercise band is permanently fixed to each leg section at the middle of the exercise band and has a length sufficient to wrap around the leg section to securely mount the exercise band to the leg section during periods of non-use.

The exercise band may comprise at least one spring loaded locking canister to fixedly connect the first and/or second free end of the exercise band to the first and/or second free end of the other exercise band during periods of use.

The exercise band may comprise at least one snap to fixedly connect the first and/or second free end of the exercise band to the first and/or second free end of the other exercise band during periods of use.

The exercise band may comprise at least one buckle to fixedly connect the first and/or second free end of the exercise band to the first and/or second free end of the other exercise band during periods of use.

The exercise band may comprise at least one hook and loop type fastener to fixedly connect the first and/or second free end of the exercise band to the first and/or second free end of the other exercise band during periods of use.

The exercise band may comprise a locking mechanism on the second free end to connect to one of the first free end, the other exercise band, or a stationary object.

The first and/or second free end of the exercise band is coupled to the first and/or second free end of the other exercise band during periods of use.

The exercise band may comprise variable resistance level.

The exercise band may comprise a plurality of fasteners sewn into the exercise band and evenly spaced along the first free end of the exercise band to provide a variable resistance level to increase or decrease the resistance. The fastener may comprise a button.

The exercise pant garment may comprise non-detachable resistance bands on each leg, the resistance bands may be wrapped around each leg section and pulled through the locking mechanism during periods of non-use.

A method of performing an exercise program wherein a user does a primary exercise involving repeated side to side movement of the user's legs may generally comprise providing an exercise pant garment comprising an upwardly disposed waist, a seat spaced apart from and connected to a pant front, the seat and the pant front connected to the waist, two spaced apart leg sections connected to the seat and the pant front, and a pair of elongated fabric, exercise resistance bands each having first and second free ends and coupled about a knee area of one of the leg sections of the exercise pant garment, wherein the first and/or second free end of the exercise band independently comprise a length sufficient to extend around the knee area and attach to the first and/or second free end of the exercise band of the other leg section, spanning the space between the leg sections to provide sufficient resistance to the movement of the legs away from each other to stimulate muscles of the lower body during a resistance exercise program, and/or a length sufficient to couple to a stationary object, spanning the space between the leg section and stationary object to provide sufficient resistance to the movement of the leg away from the stationary object to stimulate muscles of the lower body during a resistance exercise program. The length and/or resistance of each free end may be the same or different.

The method may comprise providing resistance to the user's moving legs by the exercise band stretching and resisting the movement of the user's legs when the exercise resistance bands are connected to each other and are relatively moved away from each other or to a stationary object and the legs moving away from each other or closer together.

The method may comprise providing resistance along a length of the user's moving legs directly across the space between the leg sections or the space between a stationary object and the legs when each like is used independent of the other.

The method may comprise returning the exercise resistance bands to its unstretched condition when the exercise resistance bands are connected to each other and are relatively moved toward each other. The method may comprise returning the exercise resistance bands to its unstretched condition when the exercise resistance band is connected to a stationary object and the "working" leg is moved further away from the opposing leg and closer to the stationary object.

The method may comprise repeating the stretching and resisting and returning of the exercise resistance bands by repeated side to side leg movements.

The method of claim 12, wherein each exercise band is permanently fixed about the knee area of each leg section, and each exercise band comprises a locking mechanism on the second free end to connect both exercise resistance bands to each other or to a stationary object, and the first free end of each exercise band comprises a variable resistance level to increase or decrease the resistance.

FIG. 1 illustrates the side view of the right leg of an exercise pant garment 10, that ends just below the knee, or longer, with a fabric-like, elastic exercise resistance band 11, having first and second ends, formed to the leg, with a possible length of enough to be wrapped around the wearer's leg at least once, and the first end pulled through the locking canister 12, attached to the second end, in an inconspicuous, fashionable, wearable manner when going about your everyday schedule and performing daily errands.

Figure 2:
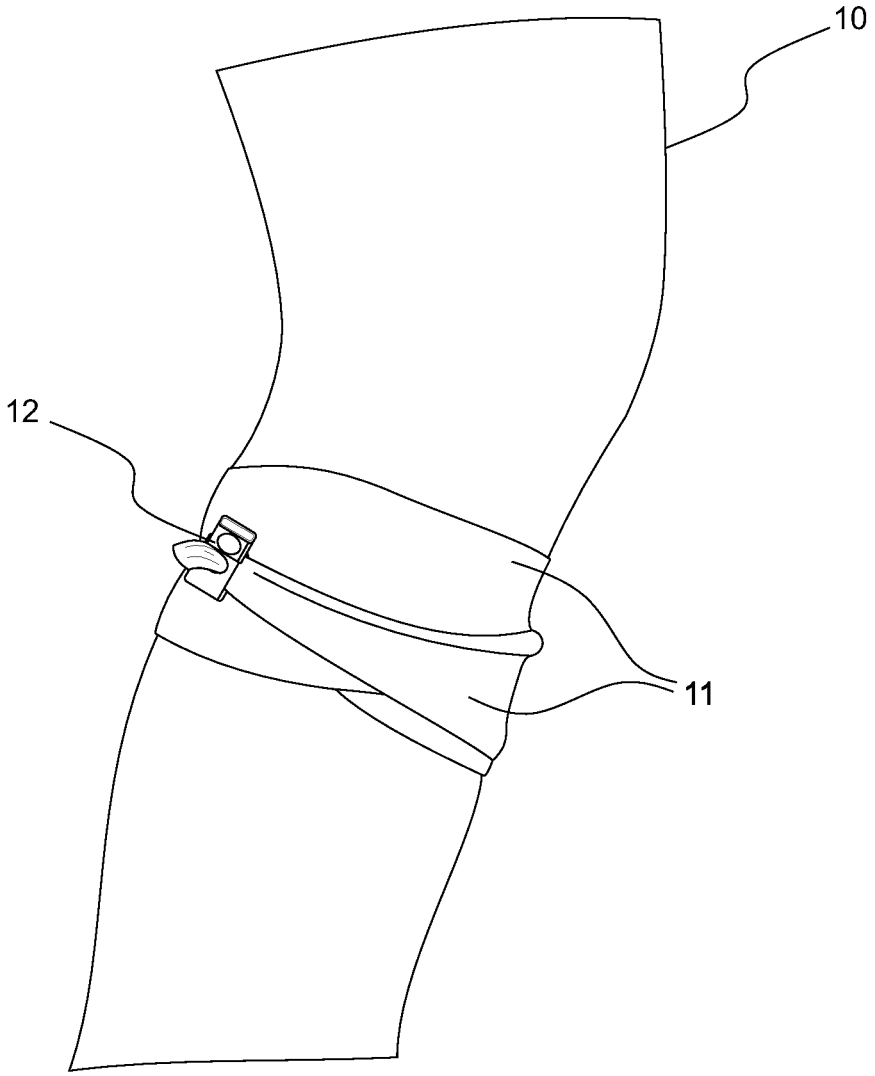

FIG. 2 illustrates the side view of the right leg of an exercise pant garment 10, that ends just below the knee, or longer, with a fabric-like, elastic exercise resistance band 11, having first and second ends, formed to the leg by way of wrapping the exercise band 11, completely around the wearer's leg and then pulling the remaining length through the locking canister 12, in an inconspicuous, fashionable, wearable manner for going about your everyday schedule and performing daily errands.

Figure 3:
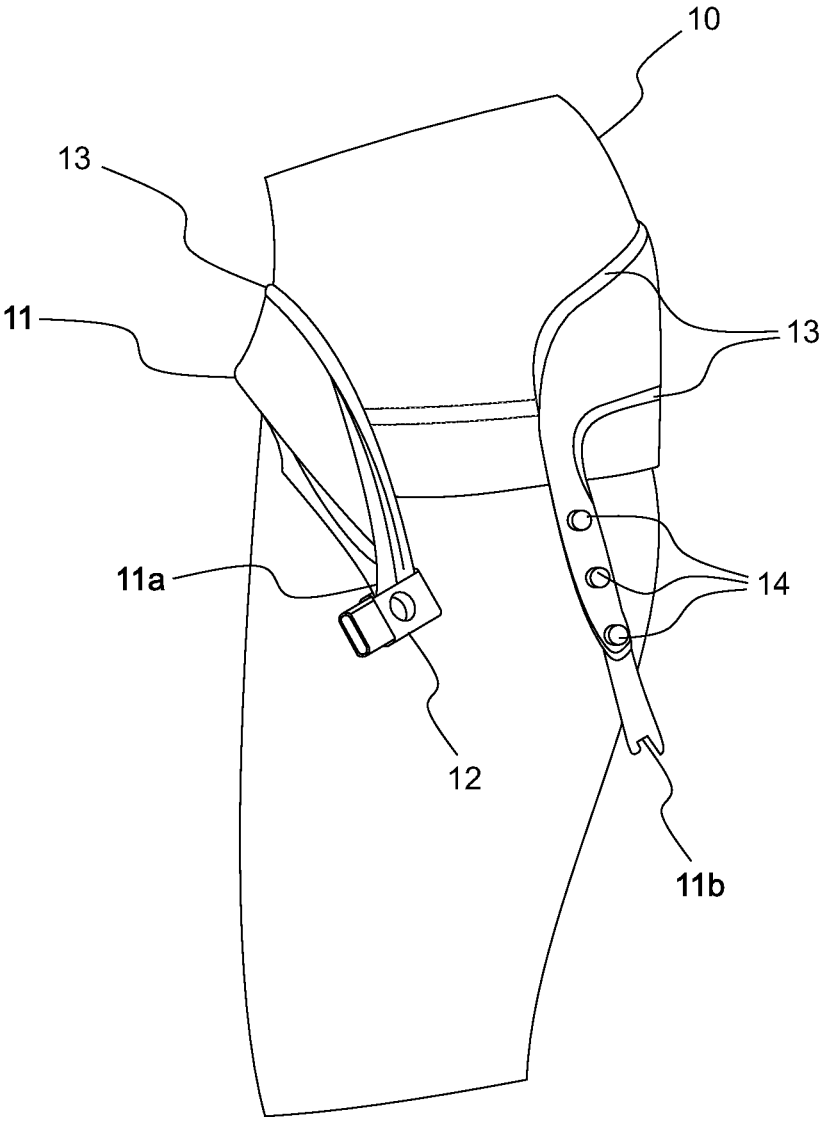
FIG. 3 illustrates a side view of a leg section of an exercise pant garment comprising an elongated fabric, exercise band coupled to the leg section during a period of non-use according to various embodiments.

FIG. 3 illustrates the side view of the right leg of an exercise pant garment 10, with the resistance band 11, unformed and sewn only halfway around the leg section at the hem and the top of the resistance band 13, leaving enough of the resistance band free to provide enough give and resistance when formed to the resistance band on the opposing leg or stationary object, with the locking canister 12, on the second end of the resistance band and the varied resistance knots or button backs 14, evenly spaced and sewn along the first end of the resistance band.

Figure 4:
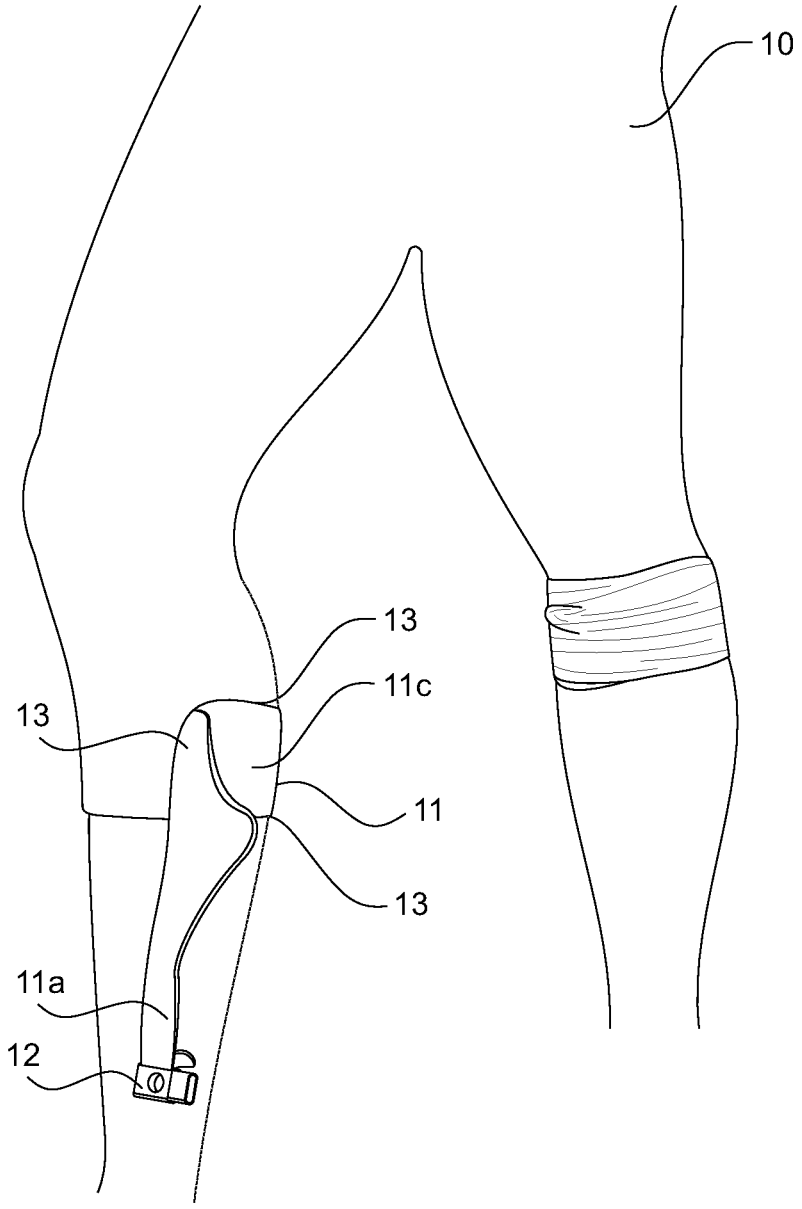
FIG. 4 illustrates a side view of an exercise pant garment during a period of non-use according to various embodiments.

FIG. 4 illustrates the side view of the left leg of an exercise pant garment 10, with the exercise resistance band 11, unformed and the stitching of the band into the leg section only halfway around the leg at the hem and top of the resistance band 13, and the locking canister 12, on the second end of the resistance band.

Figure 5:
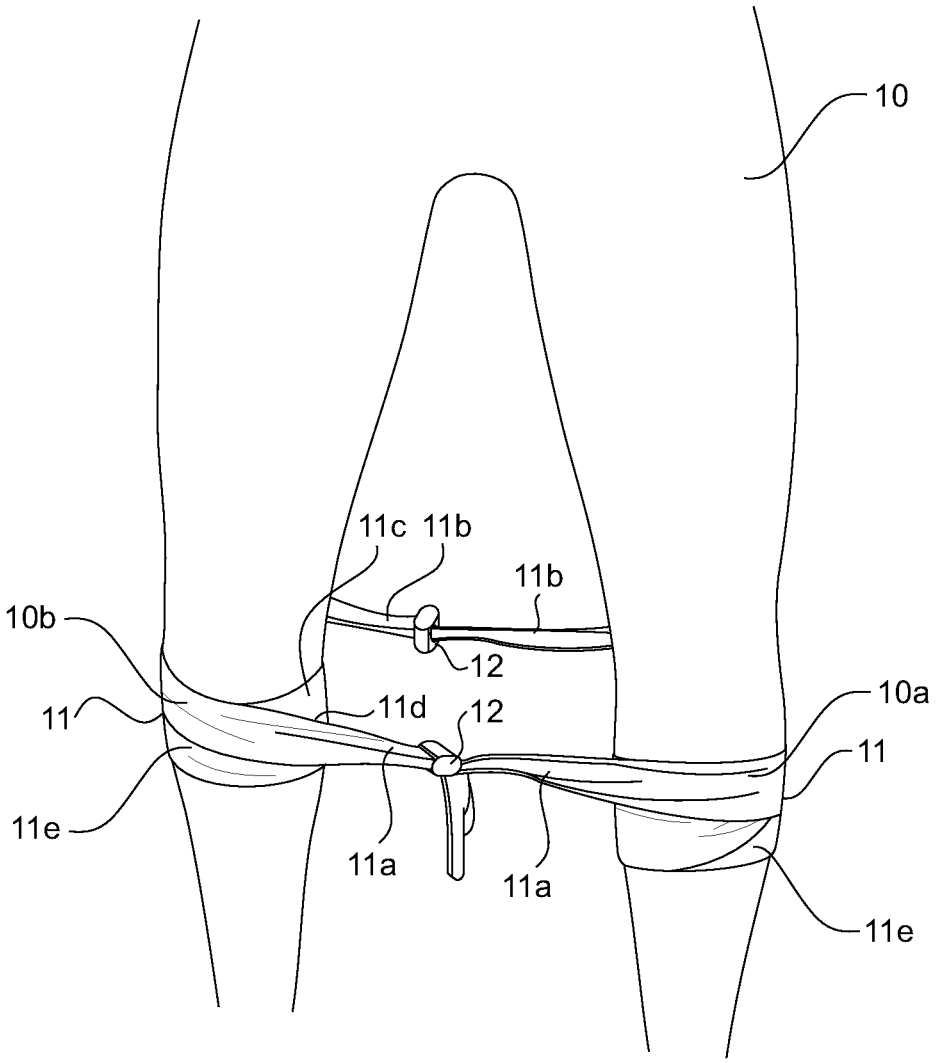
FIGS. 5-7 illustrate exercise pant garments during a period of use according to various embodiments.

FIG. 5 illustrates the front view of the exercise pant garment 10, with both exercise resistance bands 11, unformed from each leg section and formed together by way of the locking canister 12, on the second ends of both resistance bands.

Figure 6:
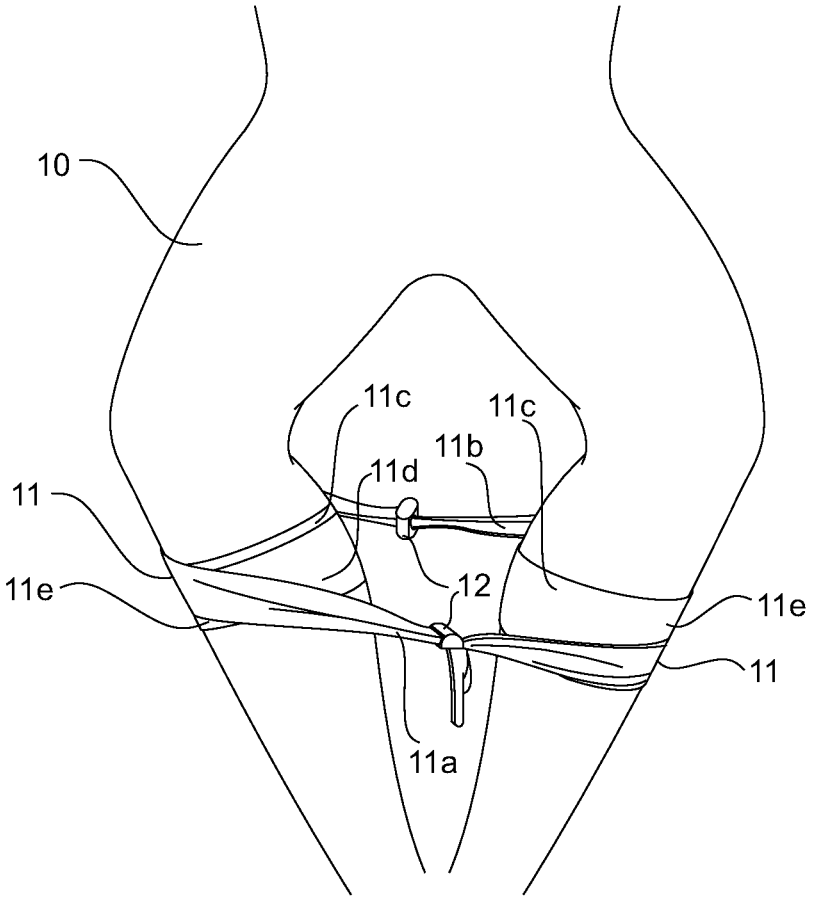

FIG. 6 illustrates the front view of the exercise pant garment 10, with both exercise resistance bands 11, unformed from each leg section and formed together by way of the locking canister 12, on the second ends of both resistance bands with the wearer laying on their side to perform resistance exercises primarily for the muscles of the buttocks.

Figure 7:
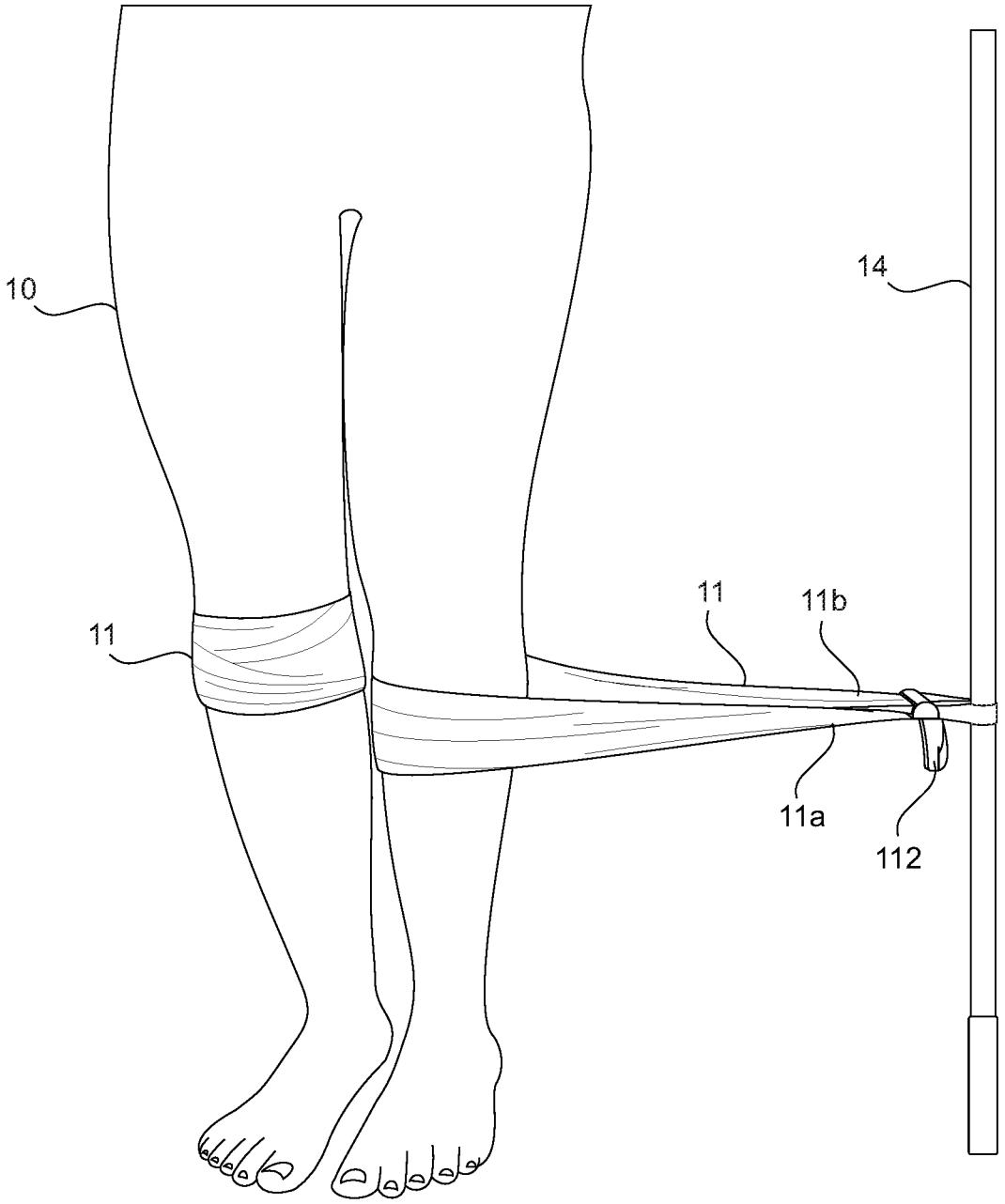

FIG. 7 illustrates the resistance band 11, unformed from the left leg section of the exercise garment 10, and formed to a stationary object 14, by way of pulling the first end of the resistance band through the locking canister 12, located on the second end of the resistance band to perform resistance exercises for the muscles of the lower body one leg at a time.

The present invention is based upon the recognition that a resistance exercise program for the lower body can be supplemented by means of resistance exercises outside the use of traditional resistance machines. More particularly, the invention provides added resistance to proven body-weight driven leg movement exercises geared to toning the muscles of the lower body by making use of a pant garment which incorporates modified structures to provide this added resistance. In general, the modified structures are resistance bands permanently attached about the knee area to each leg section of an exercise pant garment and when the resistance bands are formed together, they provide resistance to the muscles of the lower body as the legs move further away from each other while performing various lower body resistance exercises, or one end of the resistance bands may be connected to a stationary object to train the muscles of the lower body one leg at a time when that leg is moved further away from the stationary object.

The elongated diamond like shaped resistance bands are a fabric-like, elastic, resilient material, with a possible combination of nylon, lycra, latex, spandex, polyester and or rubber, having first and second ends, attached to the end of each leg section at the middle of the band and with enough length to wrap around the wearer's leg at least once and be able to form to the resistance band on the opposing leg and still offer enough give and resistance to stimulate the muscles of the lower body while performing various lower body resistance exercises. The resistance bands on each leg section are of at least a width of 0.125 to 5 inches, such as 2.5 inches, starting from the middle of the band, where it is affixed to the pant garment, and narrowing evenly out on the second end for the locking canister to be fixed to it and out on the first end, to be small enough to fit through the locking canister as well as the button backs or knots sewn into the first end used to vary the resistance and prevent the band from slipping through the locking canister during maximum resistance.

The exercise pant garment is at least a knee length, or longer, exercise pant garment made of a suitable elastic, stretchable, resilient material such as lycra, spandex and or nylon blend or a more relaxed fitting hiking or sweat pant with a possible polyester, elastane, cotton blend.

As previously noted, the length of each resistance band is of a length to at least wrap around the wearer's leg once and to allow the bands to be formed together, interconnecting both leg sections, and provide enough resistance to stimulate the muscles of the lower body, or to perform resistance exercises one leg at a time, formed to a stationary object, and allowing the muscles of the inner thigh to also be stimulated during specific adduction exercises. FIG. 7 shows how forming the resistance band on the left leg to a stationary object can offer muscle conditioning to the inner thigh of the left leg by moving the leg through a range of motion of increasing and decreasing distance between it and the right leg while tethered to the pole.

The elastic exercise resistance bands attached to each leg section, have knots or button backs sewn into the first end of the resistance band, evenly spaced apart for increased or decreased resistance to avoid slipping of the bands when pulled through the spring loaded lock canister permanently sewn into the second end of the resistance band, with possible snaps, hook and loop or buckle type fasteners, during a resistance exercise activity.

When not in use, the resistance bands can be formed to each pant leg by means of wrapping the band around the knee area and pulling the first end of the resistance band through the second end that has the locking canister on it, to keep the bands out of the way. FIG. 1 shows the resistance band tied into a small bow then pulled through the locking canister as opposed to FIG. 2 where the resistance band is wrapped entirely around the leg section and then pulled through the locking canister, giving the leg sections more of a lower profile look.

In another embodiment, the exercise resistance bands could be removable to protect the integrity of the bands and the locking canisters especially from the wear and tear of washing machines. The resistance bands could be held in place with snaps, Velcro, hook and loop type fasteners or zippers instead of stitching the resistance bands directly to the exercise pant garment.

An embodiment of utilizing the exercise pant garment includes:

an exercise pant garment (10) comprising:

an upwardly disposed waist, a seat spaced apart from and connected to a pant front, the seat and the pant front connected to the upwardly disposed waist, a first leg section (10*a*) spaced apart from a second leg section (10*b*), wherein each of the first leg section and second leg section is connected to the seat and the pant front, the first and second leg sections each having an inner perimeter side (11*d*) and an outer perimeter side (11*e*), and a first elongated fabric, exercise band (11) coupled to the first leg section and comprising a first free end (11*a*), a second free end (11*b*), and a middle portion (11*c*) between the first free end and second free end being permanently fixed by stitching or removably attached by snaps, hook and loop, or zippers about a knee area of the first leg section in relation to the inner perimeter side (11*d*) of the first leg section, the first elongated fabric, exercise band having a length adapted to at least wrap around a first leg of a wearer once, a second elongated fabric, exercise band (11) coupled to the second leg section and comprising a first free end (11*a*), a second free end (11*b*), and a middle portion (11*c*) between the first free end and second free end being permanently fixed by stitching or removably attached by snaps, hook and loop, or zippers about a knee area of the second leg section in relation to the inner perimeter side (11*d*) of the second leg section, the second elongated fabric, exercise band having a length adapted to at least wrap around a second leg of the wearer once, each of the first and second free ends, respectively, of the first and second elongated fabric, exercise bands being able to crisscross one another at the outer perimeter side (11*e*) of each of the respective first and second leg sections to extend towards the inner perimeter side of each of the respective first and second leg sections, wherein the first free end of the first elongated fabric, exercise band comprises a length to cross over a portion of the middle portion of the first elongated fabric, exercise band to extend around the knee area of the first leg section and attach to at least one of the first free end and the second free end of the second elongated fabric, exercise band spanning a first space between the first leg section and the second leg section to provide sufficient resistance adapted to the movement of legs of the wearer away from each other configured to stimulate muscles of a lower body of the wearer during a resistance exercise program, or to couple to a stationary object spanning a second space between the first leg section and the stationary object to provide sufficient resistance adapted to the movement of one of the wearer's legs away from the stationary object configured to stimulate the muscles of the wearer's lower body during a resistance exercise program, wherein the second free end of the first elongated fabric, exercise band comprises a length to cross over another portion of the middle portion of the first elongated fabric, exercise band to extend around the knee area of the first leg section and attach to at least one of the first free end and the second free end of the second elongated fabric, exercise band spanning the first space between the first leg section and the second leg section to provide sufficient resistance adapted to the movement of the wearer's legs away from each other configured to stimulate the muscles of the wearer's lower body during the resistance exercise program, and couple to the stationary object spanning the second space between the first leg section and the stationary object to provide sufficient resistance adapted to the movement of one of the wearer's legs away from the stationary object configured to stimulate the muscles of the wearer's lower body during the resistance exercise program, wherein the first free end of the second elongated fabric, exercise band comprises a length to cross the middle portion of the second elongated fabric, exercise band to extend around the knee area of the second leg section and attach to at least one of the first free end and second free end of the first elongated fabric, exercise band spanning the first space between the first leg section and second leg section to provide sufficient resistance adapted to the movement of the wearer's legs away from each other configured to stimulate the muscles of the wearer's lower body during [[a]] the resistance exercise program, or to couple to the stationary object spanning the second space between the second leg section and the stationary object to provide sufficient resistance adapted to the movement of one of the wearer's legs away from the stationary object configured to stimulate the muscles of the wearer's lower body during the resistance exercise program, and wherein the second free end of the second elongated fabric, exercise band comprises a length to cross over another portion of the middle portion of the second elongated fabric, exercise band to extend around the knee area of the second leg section and attach to at least one of the first free end and second free end of the first elongated fabric, exercise band spanning the first space between the first leg section and second leg section to provide sufficient resistance adapted to the movement of the wearer's legs away from each other configured to stimulate the muscles of the wearer's lower body during the resistance exercise program, or to couple to the stationary object spanning the second space between the second leg section and the stationary object to provide sufficient resistance adapted to the movement of one of the wearer's legs away from the stationary object configured to stimulate the muscles of the wearer's lower body during the resistance exercise program, wherein each of the middle portions of the first and second elongated fabric, exercise bands remain attached to the first and second leg sections when each of the first and second free ends of the first and second elongated fabric, exercise bands are in a first, second, third and fourth configurations, the first configuration comprising wherein each the first and second free ends of the first and second elongated fabric, exercise bands wrap around the first and second leg sections, respectively, whereby each of the first and second elongated fabric, exercise bands are securely mounted to the first and second leg sections, respectively, during periods of non-use at the inner and outer perimeter sides of the first and second leg sections, the second configuration comprising wherein each the first and second free ends of the first and second elongated fabric, exercise bands are detached from each other at the outer perimeter side of each of the first and second leg sections whereby each the first and second free ends of the first and second elongated fabric, exercise bands are capable of hanging from each of the first and second leg sections such that end portions of the first and second free ends of the first and second elongated fabric, exercise bands extend below a bottom perimeter of each of the first and second leg sections, the third configuration comprising wherein the first and second free ends of the first elongated fabric, exercise band extend from the outer perimeter side to the inner perimeter side of the first leg section to attach to at least one of the first free end and the second free end of the second elongated fabric spanning the first space between the first leg section and second leg section and wherein the first and second free ends of the second elongated fabric, exercise band extend from the outer perimeter side to the inner perimeter side of the second leg section to attach to at least one of the first free end and the second free end of the first elongated fabric spanning the first space between the first leg section and second leg section, the fourth configuration comprising wherein at least one the first and second elongated fabric, exercise bands are attached to the stationary object whereby the first and second free ends of the first elongated fabric, exercise band or wherein the first and second free ends of the second elongated fabric, exercise band extend from the outer perimeter side of their respective said first and second leg sections to attach the stationary object; and each of the first and second elongated fabric, exercise bands comprises a plurality of fasteners sewn into and evenly spaced along the first free ends of each of the first and second elongated fabric, exercise bands to provide a variable resistance level to increase or decrease the resistance."

All documents cited in the Detailed Description are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An exercise pant garment comprising:

an upwardly disposed waist, a seat spaced apart from and connected to a pant front, the seat and the pant front connected to the upwardly disposed waist, a first leg section spaced apart from a second leg section, wherein each of the first leg section and second leg section is connected to the seat and the pant front, the first and second leg sections each having an inner perimeter side and an outer perimeter side, and a first elongated fabric, exercise band coupled to the first leg section and comprising a first free end, a second free end, and a middle portion between the first free end and second free end being permanently fixed by stitching or removably attached by snaps, hook and loop, or zippers about a knee area of the first leg section in relation to at least a portion of each of the inner perimeter side and outer perimeter side of the first leg section, the first elongated fabric, exercise band having a length adapted to at least wrap around a first leg of a wearer once, a second elongated fabric, exercise band coupled to the second leg section and comprising a first free end, a second free end, and a middle portion between the first free end and second free end being permanently fixed by stitching or removably attached by snaps, hook and loop, or zippers about a knee area of the second leg section in relation to at least a portion of the inner perimeter side and outer perimeter side of the second leg section, the second elongated fabric, exercise band having a length adapted to at least wrap around a second leg of the wearer once, wherein each of the middle portions of the first and second elongated fabric, exercise bands remain attached to the first and second leg sections when each of the first and second free ends of the first and second elongated fabric, exercise bands are in a first, second, third and fourth configurations, the first configuration comprising wherein each the first and second free ends of the first and second elongated fabric, exercise bands wrap around the first and second leg sections, respectively, whereby each of the first and second elongated fabric, exercise bands are securely mounted to the first and second leg sections, respectively, during periods of non-use at the inner and outer perimeter sides of the first and second leg sections, the second configuration comprising wherein each the first and second free ends of the first and second elongated fabric, exercise bands are detached from each other at the outer perimeter side of each of the first and second leg sections whereby each the first and second free ends of the first and second elongated fabric, exercise bands are capable of hanging from each of the first and second leg sections such that end portions of the first and second free ends of the first and second elongated fabric, exercise bands extend below a bottom perimeter of each of the first and second leg sections, the third configuration comprising wherein the first and second free ends of the first elongated fabric, exercise band extend from the outer perimeter side to the inner perimeter side of the first leg section to attach to at least one of the first free end and the second free end of the second elongated fabric spanning a first space between the first leg section and second leg section and wherein the first and second free ends of the second elongated fabric, exercise band extend from the outer perimeter side to the inner perimeter side of the second leg section to attach to at least one of the first free end and the second free end of the first elongated fabric spanning the first space between the first leg section and second leg section, the fourth configuration comprising wherein at least one the first and second elongated fabric, exercise bands are attached to a stationary object whereby the first and second free ends of the first elongated fabric, exercise band or wherein the first and second free ends of the second elongated fabric, exercise band extend from the outer perimeter side of their respective said first and second leg sections to attach the stationary object.

2. The exercise pant garment of claim 1, wherein each of the first and second elongated fabric, exercise band comprises a locking mechanism on the second free end to connect to one of the first free ends of the first and second elongated fabric, exercise bands, the other of the first and second elongated fabric exercise bands, or the stationary object.

3. The exercise pant garment of claim 1, wherein each of the first free ends and second free ends of each of the first and second elongated fabric, exercise bands comprise a hook and loop type fastener.

4. The exercise pant garment of claim 1, wherein each of the first and second elongated fabric, exercise bands comprises a variable resistance level.

5. The exercise garment of claim 1, wherein each of the first and second free ends, respectively, of the first and second elongated fabric, exercise bands being able to crisscross one another at the outer perimeter side of each of the respective first and second leg sections to extend towards the inner perimeter side of each of the respective first and second leg sections, wherein the first free end of the first elongated fabric, exercise band comprises a length to cross over a portion of the middle portion of the first elongated fabric, exercise band to extend around the knee area of the first leg section and attach to at least one of the first free end and the second free end of the second elongated fabric, exercise band spanning the first space between the first leg section and the second leg section to provide sufficient resistance adapted to the movement of legs of the wearer away from each other configured to stimulate muscles of a lower body of the wearer during a resistance exercise program, or to couple to a stationary object spanning a second space between the first leg section and the stationary object to provide sufficient resistance adapted to the movement of one of the wearer's legs away from the stationary object configured to stimulate the muscles of the wearer's lower body during the resistance exercise program, wherein the second free end of the first elongated fabric, exercise band comprises a length to cross over another portion of the middle portion of the first elongated fabric, exercise band to extend around the knee area of the first leg section and attach to at least one of the first free end and the second free end of the second elongated fabric, exercise band spanning the first space between the first leg section and the second leg section to provide sufficient resistance adapted to the movement of the wearer's legs away from each other configured to stimulate the muscles of the wearer's lower body during the resistance exercise program, and couple to the stationary object spanning the second space between the first leg section and the stationary object to provide sufficient resistance adapted to the movement of one of the wearer's legs away from the stationary object configured to stimulate the muscles of the wearer's lower body during the resistance exercise program, wherein the first free end of the second elongated fabric, exercise band comprises a length to cross the middle portion of the second elongated fabric, exercise band to extend around the knee area of the second leg section and attach to at least one of the first free end and second free end of the first elongated fabric, exercise band spanning the first space between the first leg section and second leg section to provide sufficient resistance adapted to the movement of the wearer's legs away from each other configured to stimulate the muscles of the wearer's lower body during the resistance exercise program, or to couple to the stationary object spanning the second space between the second leg section and the stationary object to provide sufficient resistance adapted to the movement of one of the wearer's legs away from the stationary object configured to stimulate the muscles of the wearer's lower body during the resistance exercise program, and wherein the second free end of the second elongated fabric, exercise band comprises a length to cross over another portion of the middle portion of the second elongated fabric, exercise band to extend around the knee area of the second leg section and attach to at least one of the first free end and second free end of the first elongated fabric, exercise band spanning the first space between the first leg section and second leg section to provide sufficient resistance adapted to the movement of the wearer's legs away from each other configured to stimulate the muscles of the wearer's lower body during the resistance exercise program, or to couple to the stationary object spanning the second space between the second leg section and the stationary object to provide sufficient resistance adapted to the movement of one of the wearer's legs away from the stationary object configured to stimulate the muscles of the wearer's lower body during the resistance exercise program.

6. The exercise pant garment of claim 5, wherein each of the first and second elongated fabric, exercise bands comprises a plurality of fasteners sewn into and evenly spaced along the first free ends of each of the first and second elongated fabric, exercise bands to provide a variable resistance level to increase or decrease the resistance.

7. An exercise pant garment comprising:

an upwardly disposed waist, a seat spaced apart from and connected to a pant front, the seat and the pant front connected to the upwardly disposed waist, a first leg section spaced apart from a second leg section, wherein each of the first leg section and second leg section is connected to the seat and the pant front, the first and second leg sections each having an anterior side and a posterior perimeter side, and a first elongated fabric, exercise band coupled to the first leg section and comprising a first free end, a second free end, and a middle portion between the first free end and second free end being permanently fixed by stitching or removably attached by snaps, hook and loop, or zippers about a knee area of the first leg section in relation to the posterior side of the first leg section, the first elongated fabric, exercise band having a length adapted to at least wrap around a first leg of a wearer once, a second elongated fabric, exercise band coupled to the second leg section and comprising a first free end, a second free end, and a middle portion between the first free end and second free end being permanently fixed by stitching or removably attached by snaps, hook and loop, or zippers about a knee area of the second leg section in relation to the posterior side of the second leg section, the second elongated fabric, exercise band having a length adapted to at least wrap around a second leg of the wearer once, wherein each of the middle portions of the first and second elongated fabric, exercise bands remain attached to the first and second leg sections when each of the first and second free ends of the first and second elongated fabric, exercise bands are in a first, second, third and fourth configurations, the first configuration comprising wherein each the first and second free ends of the first and second elongated fabric, exercise bands wrap around the first and second leg sections, respectively, whereby each of the first and second elongated fabric, exercise bands are securely mounted to the first and second leg sections, respectively, during periods of non-use at the anterior and posterior perimeter sides of the first and second leg sections, the second configuration comprising wherein each the first and second free ends of the first and second elongated fabric, exercise bands are detached from each other at the anterior perimeter side of each of the first and second leg sections whereby each the first and second free ends of the first and second elongated fabric, exercise bands are capable of hanging from each of the first and second leg sections such that end portions of the first and second free ends of the first and second elongated fabric, exercise bands extend below a bottom perimeter of each of the first and second leg sections, the third configuration comprising wherein the first and second free ends of the first elongated fabric, exercise band extend from the posterior perimeter side to the anterior perimeter side of the first leg section to attach to at least one of the first free end and the second free end of the second elongated fabric spanning a first space between the first leg section and second leg section and wherein the first and second free ends of the second elongated fabric, exercise band extend from the posterior perimeter side to the anterior perimeter side of the second leg section to attach to at least one of the first free end and the second free end of the first elongated fabric spanning the first space between the first leg section and second leg section, the fourth configuration comprising wherein at least one the first and second elongated fabric, exercise bands are attached to a stationary object whereby the first and second free ends of the first elongated fabric, exercise band or wherein the first and second free ends of the second elongated fabric, exercise band extend from the posterior perimeter side of their respective said first and second leg sections to attach the stationary object.

8. The exercise pant garment of claim 7, wherein each of the first and second elongated fabric, exercise band comprises a locking mechanism on the second free end to connect to one of the first free ends of the first and second elongated fabric, exercise bands, the other of the first and second elongated fabric exercise bands, or the stationary object.

9. The exercise pant garment of claim 7, wherein each of the first free ends and second free ends of each of the first and second elongated fabric, exercise band comprise a hook and loop type fastener.

10. The exercise pant garment of claim 7, wherein each of the first and second elongated fabric, exercise bands comprises a variable resistance level.

11. The exercise pant garment of claim 7, wherein each of the first and second free ends, respectively, of the first and second elongated fabric, exercise bands being able to crisscross one another at the outer perimeter side of each of the respective first and second leg sections to extend towards the inner perimeter side of each of the respective first and second leg sections, wherein the first free end of the first elongated fabric, exercise band comprises a length to cross over a portion of the middle portion of the first elongated fabric, exercise band to extend around the knee area of the first leg section and attach to at least one of the first free end and the second free end of the second elongated fabric, exercise band spanning the first space between the first leg section and the second leg section to provide sufficient resistance adapted to the movement of legs of the wearer away from each other configured to stimulate muscles of a lower body of the wearer during a resistance exercise program, or to couple to a stationary object spanning a second space between the first leg section and the stationary object to provide sufficient resistance adapted to the movement of one of the wearer's legs away from the stationary object configured to stimulate the muscles of the wearer's lower body during the resistance exercise program, wherein the second free end of the first elongated fabric, exercise band comprises a length to cross over another portion of the middle portion of the first elongated fabric, exercise band to extend around the knee area of the first leg section and attach to at least one of the first free end and the second free end of the second elongated fabric, exercise band spanning the first space between the first leg section and the second leg section to provide sufficient resistance adapted to the movement of the wearer's legs away from each other configured to stimulate the muscles of the wearer's lower body during the resistance exercise program, and couple to the stationary object spanning the second space between the first leg section and the stationary object to provide sufficient resistance adapted to the movement of one of the wearer's legs away from the stationary object configured to stimulate the muscles of the wearer's lower body during the resistance exercise program, wherein the first free end of the second elongated fabric, exercise band comprises a length to cross the middle portion of the second elongated fabric, exercise band to extend around the knee area of the second leg section and attach to at least one of the first free end and second free end of the first elongated fabric, exercise band spanning the first space between the first leg section and second leg section to provide sufficient resistance adapted to the movement of the wearer's legs away from each other configured to stimulate the muscles of the wearer's lower body during the resistance exercise program, or to couple to the stationary object spanning the second space between the second leg section and the stationary object to provide sufficient resistance adapted to the movement of one of the wearer's legs away from the stationary object configured to stimulate the muscles of the wearer's lower body during the resistance exercise program, and wherein the second free end of the second elongated fabric, exercise band comprises a length to cross over another portion of the middle portion of the second elongated fabric, exercise band to extend around the knee area of the second leg section and attach to at least one of the first free end and second free end of the first elongated fabric, exercise band spanning the first space between the first leg section and second leg section to provide sufficient resistance adapted to the movement of the wearer's legs away from each other configured to stimulate the muscles of the wearer's lower body during the resistance exercise program, or to couple to the stationary object spanning the second space between the second leg section and the stationary object to provide sufficient resistance adapted to the movement of one of the wearer's legs away from the stationary object configured to stimulate the muscles of the wearer's lower body during the resistance exercise program.

12. The exercise pant garment of claim 11, wherein each of the first and second elongated fabric, exercise bands comprises a plurality of fasteners sewn into and evenly spaced along the first free ends of each of the first and second elongated fabric, exercise bands to provide a variable resistance level to increase or decrease the resistance.

13. An exercise pant garment comprising:

an upwardly disposed waist, a seat spaced apart from and connected to a pant front, the seat and the pant front connected to the upwardly disposed waist, a first leg section spaced apart from a second leg section, wherein each of the first leg section and second leg section is connected to the seat and the pant front, the first and second leg sections each having a first perimeter side and a second perimeter side, and a first elongated fabric, exercise band coupled to the first leg section and comprising a first free end, a second free end, and a middle portion between the first free end and second free end being permanently fixed by stitching or removably attached by snaps, hook and loop, or zippers about a knee area of the first leg section in relation to the first perimeter side of the first leg section, the first elongated fabric, exercise band having a length adapted to at least wrap around a first leg of a wearer once, a second elongated fabric, exercise band coupled to the second leg section and comprising a first free end, a second free end, and a middle portion between the first free end and second free end being permanently fixed by stitching or removably attached by snaps, hook and loop, or zippers about a knee area of the second leg section in relation to the first perimeter side of the second leg section, the second elongated fabric, exercise band having a length adapted to at least wrap around a second leg of the wearer once, wherein each of the middle portions of the first and second elongated fabric, exercise bands remain attached to the first and second leg sections when each of the first and second free ends of the first and second elongated fabric, exercise bands are in a first, second, third and fourth configurations, the first configuration comprising wherein each the first and second free ends of the first and second elongated fabric, exercise bands wrap around the first and second leg sections, respectively, whereby each of the first and second elongated fabric, exercise bands are securely mounted to the first and second leg sections, respectively, during periods of non-use at the inner and outer perimeter sides of the first and second leg sections, the second configuration comprising wherein each the first and second free ends of the first and second elongated fabric, exercise bands are detached from each other at the outer perimeter side of each of the first and second leg sections whereby each the first and second free ends of the first and second elongated fabric, exercise bands are capable of hanging from each of the first and second leg sections such that end portions of the first and second free ends of the first and second elongated fabric, exercise bands extend below a bottom perimeter of each of the first and second leg sections, the third configuration comprising wherein the first and second free ends of the first elongated fabric, exercise band extend from the outer perimeter side to the inner perimeter side of the first leg section to attach to at least one of the first free end and the second free end of the second elongated fabric spanning a first space between the first leg section and second leg section and wherein the first and second free ends of the second elongated fabric, exercise band extend from the outer perimeter side to the inner perimeter side of the second leg section to attach to at least one of the first free end and the second free end of the first elongated fabric spanning the first space between the first leg section and second leg section, the fourth configuration comprising wherein at least one the first and second elongated fabric, exercise bands are attached to a stationary object whereby the first and second free ends of the first elongated fabric, exercise band or wherein the first and second free ends of the second elongated fabric, exercise band extend from the outer perimeter side of their respective said first and second leg sections to attach the stationary object;

wherein the middle portion between the first free end and second free end being permanently fixed by stitching or removably attached by snaps, hook and loop, or zippers about a knee area of the first leg section in relation to the bottom perimeter of the first leg section;

wherein the middle portion between the first free end and second free end being permanently fixed by stitching or removably attached by snaps, hook and loop, or zippers about a knee area of the second leg section in relation to the bottom perimeter of the second leg section.

14. The exercise pant garment of claim 13, wherein each of the middle portions of the first and second elongated fabric, exercise bands is permanently fixed by stitching or removably attached by snaps, hook and loop, or zippers to a side seam of the bottom perimeter of the first and second leg section, respectively.

15. The exercise pant garment of claim 14, wherein each of the middle portions of the first and second elongated fabric, exercise bands is permanently fixed by stitching to an inseam of the bottom perimeter of the first and second leg section, respectively.

16. The exercise pant garment of claim 13, wherein each of the first and second elongated fabric, exercise band comprises a locking mechanism on the second free end to connect to one of the first free ends of the first and second elongated fabric, exercise bands, the other of the first and second elongated fabric exercise bands, or the stationary object.

17. The exercise pant garment of claim 13, wherein each of the first free ends and second free ends of each of the first and second elongated fabric, exercise band comprise a hook and loop type fastener.

18. The exercise pant garment of claim 13, wherein each of the first and second elongated fabric, exercise bands comprises a variable resistance level.

19. The exercise garment of claim 13, wherein each of the first and second free ends, respectively, of the first and second elongated fabric, exercise bands being able to crisscross one another at the outer perimeter side of each of the respective first and second leg sections to extend towards the inner perimeter side of each of the respective first and second leg sections, wherein the first free end of the first elongated fabric, exercise band comprises a length to cross over a portion of the middle portion of the first elongated fabric, exercise band to extend around the knee area of the first leg section and attach to at least one of the first free end and the second free end of the second elongated fabric, exercise band spanning the first space between the first leg section and the second leg section to provide sufficient resistance adapted to the movement of legs of the wearer away from each other configured to stimulate muscles of a lower body of the wearer during a resistance exercise program, or to couple to a stationary object spanning a second space between the first leg section and the stationary object to provide sufficient resistance adapted to the movement of one of the wearer's legs away from the stationary object configured to stimulate the muscles of the wearer's lower body during the resistance exercise program, wherein the second free end of the first elongated fabric, exercise band comprises a length to cross over another portion of the middle portion of the first elongated fabric, exercise band to extend around the knee area of the first leg section and attach to at least one of the first free end and the second free end of the second elongated fabric, exercise band spanning the first space between the first leg section and the second leg section to provide sufficient resistance adapted to the movement of the wearer's legs away from each other configured to stimulate the muscles of the wearer's lower body during the resistance exercise program, and couple to the stationary object spanning the second space between the first leg section and the stationary object to provide sufficient resistance adapted to the movement of one of the wearer's legs away from the stationary object configured to stimulate the muscles of the wearer's lower body during the resistance exercise program, wherein the first free end of the second elongated fabric, exercise band comprises a length to cross the middle portion of the second elongated fabric, exercise band to extend around the knee area of the second leg section and attach to at least one of the first free end and second free end of the first elongated fabric, exercise band spanning the first space between the first leg section and second leg section to provide sufficient resistance adapted to the movement of the wearer's legs away from each other configured to stimulate the muscles of the wearer's lower body during the resistance exercise program, or to couple to the stationary object spanning the second space between the second leg section and the stationary object to provide sufficient resistance adapted to the movement of one of the wearer's legs away from the stationary object configured to stimulate the muscles of the wearer's lower body during the resistance exercise program, and wherein the second free end of the second elongated fabric, exercise band comprises a length to cross over another portion of the middle portion of the second elongated fabric, exercise band to extend around the knee area of the second leg section and attach to at least one of the first free end and second free end of the first elongated fabric, exercise band spanning the first space between the first leg section and second leg section to provide sufficient resistance adapted to the movement of the wearer's legs away from each other configured to stimulate the muscles of the wearer's lower body during the resistance exercise program, or to couple to the stationary object spanning the second space between the second leg section and the stationary object to provide sufficient resistance adapted to the movement of one of the wearer's legs away from the stationary object configured to stimulate the muscles of the wearer's lower body during the resistance exercise program.

20. The exercise pant garment of claim 13, wherein each of the first and second elongated fabric, exercise bands comprises a plurality of fasteners sewn into and evenly spaced along the first free ends of each of the first and second elongated fabric, exercise bands to provide a variable resistance level to increase or decrease the resistance.

* * * * *